US010710149B2

(12) United States Patent
Ploederl et al.

(10) Patent No.: US 10,710,149 B2
(45) Date of Patent: Jul. 14, 2020

(54) CORE BOX FOR MANUFACTURING CASTING CORES

(71) Applicant: Nemak, S.A.B. de C.V., Garcia (MX)

(72) Inventors: Günther Ploederl, Herzogsdorf (AT); Markus Gressenbauer, St. Pankraz (AT); Günter Mondl, Neuhofen an der Krems (AT); Ingo Prass, Gallneukirchen (AT)

(73) Assignee: Nemak, S.A.B. de C.V., Garcia, Nuevo Leon (MX)

( * ) Notice: Subject to any disclaimer, the term of this patent is extended or adjusted under 35 U.S.C. 154(b) by 0 days.

(21) Appl. No.: 15/568,254

(22) PCT Filed: Apr. 8, 2016

(86) PCT No.: PCT/IB2016/000449
§ 371 (c)(1),
(2) Date: Oct. 20, 2017

(87) PCT Pub. No.: WO2016/170409
PCT Pub. Date: Oct. 27, 2016

(65) Prior Publication Data

US 2018/0141109 A1 May 24, 2018

(30) Foreign Application Priority Data

Apr. 21, 2015 (DE) ..... 10 2015 106 126

(51) Int. Cl.
*B22C 7/06* (2006.01)
*B22C 9/10* (2006.01)

(52) U.S. Cl.
CPC . *B22C 7/06* (2013.01); *B22C 9/10* (2013.01)

(58) Field of Classification Search
CPC .. B22C 7/06; B22C 7/062; B22C 9/00; B22C 9/10
See application file for complete search history.

(56) References Cited

U.S. PATENT DOCUMENTS 3,581,801 A * 6/1971 Hulslander ..... B22C 7/067 164/22
3,857,439 A * 12/1974 Bardet ..... B22C 9/123 164/186
4,379,101 A * 4/1983 Smith ..... B27N 5/00 264/109

FOREIGN PATENT DOCUMENTS

CN 201217056 Y 4/2009
CN 201261059 Y 6/2009
(Continued)

OTHER PUBLICATIONS

English Machine Translation of CN 202725947 (Year: 2013).*

*Primary Examiner* — Kevin P Kerns
*Assistant Examiner* — Steven S Ha
(74) *Attorney, Agent, or Firm* — The Webb Law Firm

(57) ABSTRACT

The invention relates to a core box for manufacturing casting cores from a moulding material rigidified by supply of heat, including at least two core box parts, which together provide the shape of the casting cores to be manufactured and a heating device for heating the core box parts. The heating device has at least one oil line in thermal contact with at least one of the core box parts and connected to an oil supply feeding the oil line with a tempered oil for heating the core box parts. The invention divides at least one of the core box parts into a contour plate, providing the shape of the casting cores to be manufactured, and a heating plate connected to the contour plate, said heating plate extending flat over the contour plate and in which the oil line is provided.

18 Claims, 4 Drawing Sheets

(56) References Cited

FOREIGN PATENT DOCUMENTS

| | | | |
|---|---|---|---|
| CN | 201768876 | U | 3/2011 |
| CN | 201791913 | U | 4/2011 |
| CN | 102189217 | A | 9/2011 |
| CN | 201979038 | U | 9/2011 |
| CN | 202725947 | U | 2/2013 |
| CN | 103769535 | A | 5/2014 |
| DE | 19632293 | A1 | 2/1998 |
| JP | 523793 | A | 2/1993 |
| JP | 2011218406 | A | 11/2011 |

* cited by examiner

CORE BOX FOR MANUFACTURING CASTING CORES

CROSS-REFERENCE TO RELATED APPLICATIONS

This application is the United States national phase of International Application No. PCT/IB2016/000449 filed Apr. 8, 2016, and claims priority to German Patent Application No. 10 2015 106 126.0 filed Apr. 21, 2015, the disclosures of which are hereby incorporated in their entirety by reference.

BACKGROUND OF THE INVENTION

Field of the Invention

The invention relates to a core box for manufacturing casting cores from a moulding material rigidified by supply of heat, comprising at least two core box parts, which together provide the shape of the casting cores to be manufactured and a heating device for heating the core box parts, wherein the heating device comprises at least one oil line, which is in thermal contact with at least one of the core box parts and is connected to an oil supply which feeds the oil line with a tempered oil for heating the core box part.

Description of Related Art

Core boxes of the type in question here are used in core shooters by means of which casting cores are manufactured for manufacturing casting parts. The core boxes, in this regard, enclose a mould cavity with the core box parts thereof, the boundary surfaces of said mould cavity moulding the contour of the casting core to be manufactured. The respective moulding material is shot under pressure into the mould cavity of the core box so that a compact core results.

Moulding materials, for the processing of which a core box according to the invention is in particular suitable, are mixed from a moulding sand and an inorganic binder as well as optional additives.

In the case of the manufacturing of casting cores for example described in DE 196 32 293 A1 using so-called inorganic hot box core sand binder systems, the cores are rigidified in the mould cavity of the core box through the removal of water. To this end, the moulding material mass is supplied with heat in the core box and the escaping moisture is removed via generally slot-shaped openings moulded into the core box parts, also called "slotted nozzles" in technical language.

This process can be accelerated by gassing the moulding material mass shot into the mould cavity with hot air, which is blown via injection openings into the mould cavity of the core box and is channelled out via the slot-shaped openings.

In the case of core shooters used in practice, the supply of heat takes place via the core box parts, which are usually manufactured from a sufficiently rigidified and good heat-conductive tool steel, for example the steel with the material number 1.2343. Bores are introduced into the core box parts for the supply of heat, through which a sufficiently hot oil is directed.

Boring of this type of the respectively straight running oil lines into the respective core box part is not only complex in terms of manufacturing, but also, due to the fact that the individual sections of the oil line have to necessarily run straight, it limits the possibilities of the design and arrangement of the ventilation slots required in the respective core box part.

SUMMARY OF THE INVENTION

In light of this, the object is to provide an oil-heatable core box which can be manufactured with reduced complexity and in this regard ensures maximum freedom in terms of the design.

In order to achieve this object, the invention proposes a core box having the features as described herein.

Advantageous configurations of the invention are explained in detail below.

In accordance with the prior art explained in the introduction, a core box, according to the invention, for manufacturing casting cores from a moulding material, which is mixed from a moulding sand and a binder as well as optional additives, also comprises at least two core box parts, which together provide the shape of the casting cores to be manufactured and a heating device for heating the core casting parts. In this regard, the heating device comprises at least one oil line, which is in thermal contact with at least one of the core casting parts and is connected to an oil supply which feeds the oil line with a tempered oil for heating the core box part.

According to the invention, at least one of the core casting parts is now divided into a contour plate providing the shape of the casting cores to be manufactured and a heating plate in which the oil line is provided, wherein the heating plate extends flat over the contour plate and is coupled to the contour plate.

By way of the division according to the invention of the core box part into a contour plate and a heating plate, it is possible to optimally configure and to design both the contour plate and the heating plate respectively in relation to the purpose of use thereof. Unlike conventional oil-heated core boxes in which the hot oil is directed through oil bores moulded in the respective core box part, an unrestricted freedom of design, in particular in relation to the positioning of slotted nozzles on the contour plate, is provided in the case of a core box according to the invention. In the case of a core box according to the invention, it is thus possible to position any number of slotted nozzles without problems such that a quick removal of moisture from the casting cores and associated therewith an accelerated curing process is ensured. In addition, the contour part can be easily uninstalled for repairing wears, subjected to a repair, for example, by machining or welding and reinstalled. The danger of damage occurring, in this regard, to oil-conductive lines or igniting residual oil in the case of welding, does not exist in this regard.

The invention thus enables, using simple means, the practical use of oil heating for the tempering of a core box. Unlike alternative heating devices, such as electric heating for example, heating the contour-defining plates of a core box according to the invention, based on a heated oil, is, in this regard, characterised by increased process safety due to reduced risk of failure and long service life. At the same time, core boxes according to the invention are easy to clean by separating contour plates and heating plates. In particular, an ultrasonic bath is suitable for this purpose, which is, for example, not possible in the case of electrically operating heating due to the danger of water penetrating.

It is essentially conceivable to embed the oil line provided in the heating plate as a separately pre-fabricated line into a suitable carrier material. The heating plate then functions first and foremost as a holder and protection for the oil line on the contour part. Naturally the oil line in this configuration is optimally arranged such that there is direct thermal contact between said oil line and the contour plate.

It is also conceivable to mould the oil line into a heating plate, which consists of a material that can be easily processed, but has sufficient temperature resistance. All modern methods that allow lines and cavities to be formed in a material plate are suitable here. Suitable three-dimensional printing processes or the like could, for example be used to this end, which allow even complex line routes to be precisely provided in a compact plate body after concluding the printing process.

In the case of a core box according to the invention, the contour plates naturally consist of a highly temperature-conductive material, in particular an established tool steel of the type mentioned above suitable for these purposes. In terms of the efficiency of the heat transfer and distribution of the heat on the contour plate, in this regard, results when the heating plate also consists of a thermally good conductive material. Since the heating plate, however, is neither exposed to high mechanical or extreme or changeable thermal loads, to this end inexpensive materials are sufficient, such as a low-alloyed steel or a light metal material, in particular an Al material. In particular the use of light metal materials also has a favourable effect on the weight of the core box according to the invention.

If the oil line is moulded into the material of the heating plate and if moulding, in particular machining processes are conventionally used for the moulding, then it is proven to be advantageous from a manufacturing view if the oil line is moulded into one of the sides of the heating plate in the manner of a channel, which extends parallel to the associated contour plate. The oil channel moulded into the plate side concerned in the manner of a groove is openly accessible when the heating plate is uninstalled and can thus not only be easily moulded into the material, but can also be easily cleaned.

If the oil line channel is moulded into the side of the heating plate associated with the contour plate, then the contour plate covers the oil line channel on the open side thereof when the core box is fully installed. In this regard, there can be direct contact between the hot oil and the contour plate in the case of suitable sealing of the joints between heating plate and contour plate.

It is, however, also conceivable to arrange a separate sealing plate between the heating plate and the contour plate in order to easily ensure a secure sealing. Such a sealing plate is also expediently used when the oil line is moulded into a side of the heating plate facing away from the contour plate.

In the case that a sealing plate is arranged between heating plate and contour plate, it expediently consists of a thermally good conductive material.

A good heat transfer from the heating plate to the contour plate can, in this regard, be ensured by the contour plate, the heating plate or the sealing plate consisting of a material with a heat conductivity $\lambda$ of at least 40 W/(m*K), wherein naturally at least the plate, which simultaneously and directly comes into contact with the hot oil and the contour plate respectively, should consist of such a good conductive material. For the purposes according to the invention, all iron and light metal-based alloys have sufficient heat conductivity.

Due to the particular design features thereof and the advantages achieved thereby, a core box according to the invention is suitable in particular for core manufacturing methods, which require hot air gassing. This is why a core box according to the invention can be used in particular for core manufacturing methods, in the case of which inorganic binder systems are used.

BRIEF DESCRIPTION OF THE DRAWINGS

The invention is explained further below with reference to a drawing showing an example embodiment. The figures thereof respectively schematically show.

DETAILED DESCRIPTION OF THE INVENTION

Figure 1:
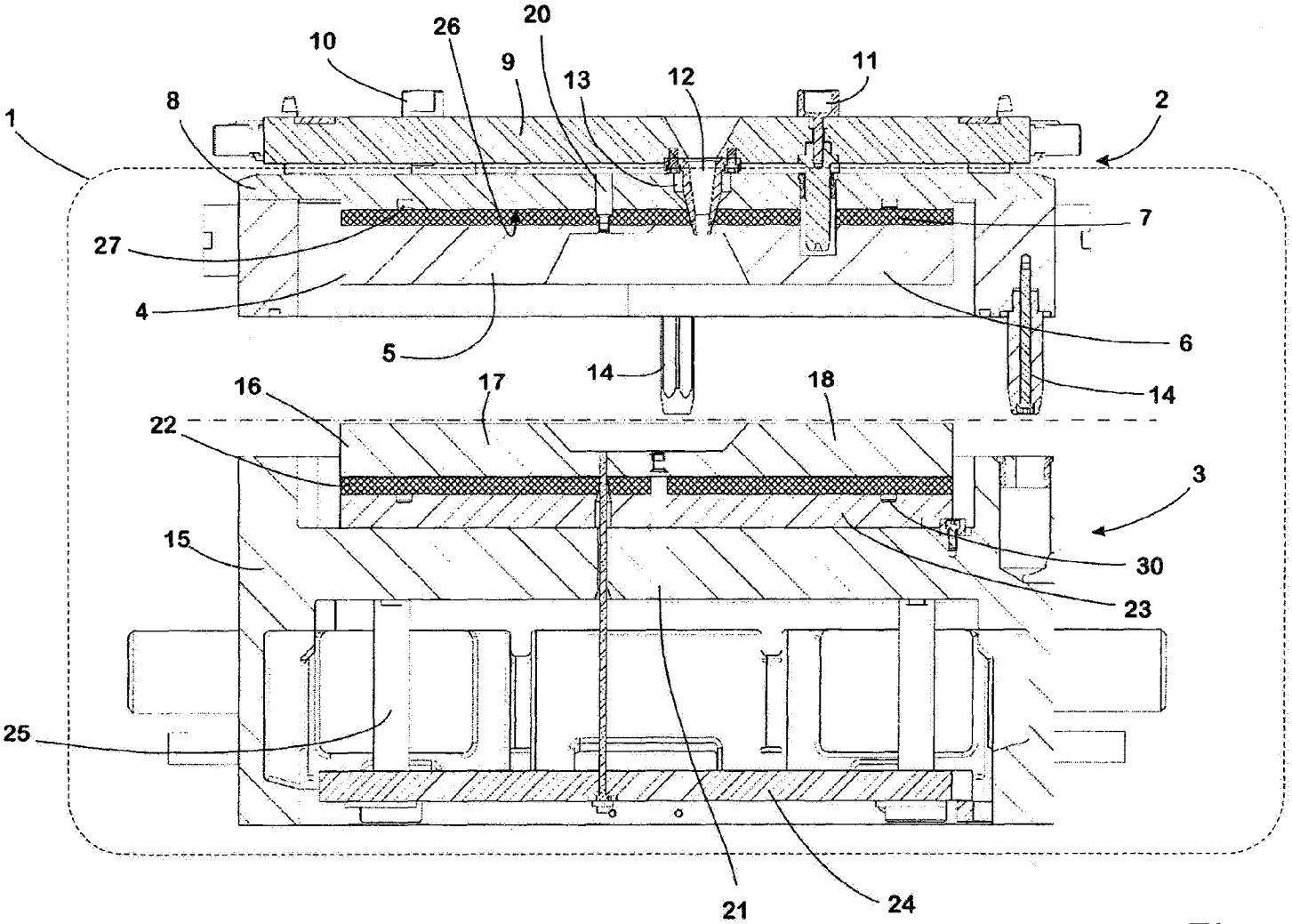
FIG. 1 a core box in a longitudinal section.

The core box 1 comprises an upper core box part 2 and a lower core box part 3.

The upper core box part 2 is composed of a contour plate 4, which bears contour-defining moulding elements 5, 6 on the side thereof associated with the lower core box part 3, a sealing plate 7 located on the contour plate 4, a heating plate 8 situated on the sealing plate 7 and a shooting plate 9 supported thereon.

The shooting plate 9 is coupled via coupling elements to the contour plate 4 in a manner known per se by means of mortise joints 10, 11 and aligned in this regard such that the shooting funnel 12 of the shooting plate 9 sits perfectly into the associated shooting openings 13, which are moulded in a vertical direction flush to each other into the contour plate 4, the sealing plate 7 and the heating plate 8.

In order to ensure a correctly-positioned coupling to the lower core box part 3, pins 14 pointing in the direction of the lower core box part 3 are fixed in the edge region of the contour plate 4, said pins engaging into correspondingly formed depressions when the upper core box part 2 lowers, said depressions being moulded in the edge region of the upper side of the lower core box part 3 associated with the upper core box part 2.

The lower core box part 3 comprises a base frame 15, which bears a contour plate 16 of the lower box part 3 on the side thereof associated with the upper core box part 2. The contour plate 16 bears contour-defining moulding elements 17, 18 on the free side thereof associated with the upper core box part 2.

Figure 2:
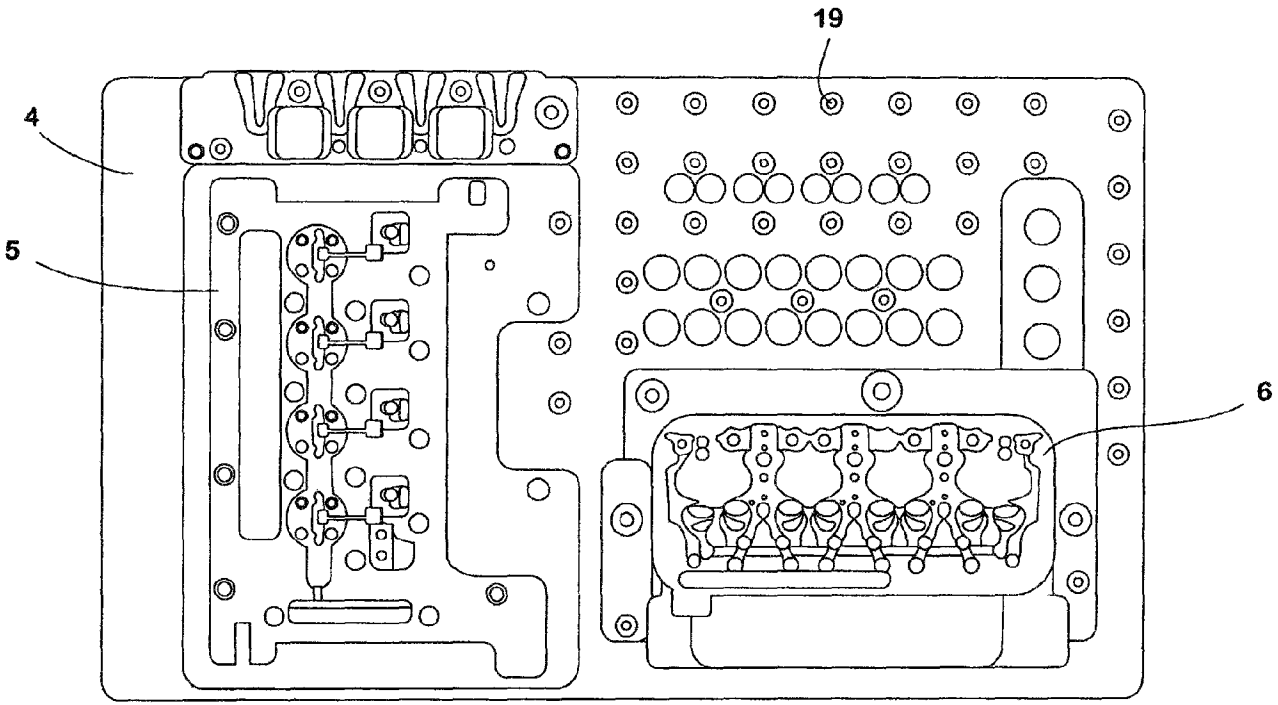
FIG. 2 a contour plate of the core box according to FIG. 1 in a top view.

In the case of a closed core box 1, i.e. in the state in which the upper core box 2 sits on the lower core box 3, the contour plates 4, 16 enclose a mould cavity in which a plurality of cores, for example the cores for the inlet channel, the outlet channel, the water jacket, the lid and the oil chamber of a cylinder head for a combustion motor can be simultaneously shot. The shapes of the cores are, in this regard, determined by the moulding elements 5, 6, 17, 18, of which only two moulding elements 5, 6 are shown in FIG. 2 for the sake of clarity for the contour plate 4 of the upper core box part 2. Assembly openings 19 provided on the contour plate 4, 16 allow for the fixing of the most varied of moulding elements such that different casting core programmes can be produced by means of the core box 1.

Conventionally designed slotted nozzles 20, 21 are respectively arranged in the upper and lower core box part 2, 3, said slotted nozzles reach, in the case of the upper core box part 2, from the upper side thereof to the side of the contour plate 4 associated with the lower core box part 3 and, in the case of the lower core box part 3, from the lower side thereof to the side of the contour plate 16 associated with the upper box part 2. In this way, gases present or forming in the mould cavity then surrounded by the contour plates 4, 16 can escape via the slotted nozzles in the case of a closed core box 1.

The contour plate 16 sits over a sealing plate 22 on a heating plate 23 of the lower core box part 3. The packet formed by contour plate 16, sealing plate 22 and heating plate 23 sits in a seating of the base frame 15.

An ejector plate 24 is arranged below it, which bears ejectors 25 pointing in the direction of the contour plate 16. The ejectors 25 engage through through-openings moulded into the lower contour plate 16. After curing the casting cores formed in the core box 1, the ejector plate 24 is raised in the direction of the contour plate 16 in the case of the open core box 1 such that the ejectors 25 raise the completed casting cores from the moulded parts 17, 18. The completed casting cores can then be freely removed from the core box 1.

While the contour plates 4, 16 having the moulded elements 5, 6, 17, 18 borne thereby respectively consist of a high-value, wear and temperature-resistant tool steel, the heating plates 8, 23 respectively consist of an aluminium material. Alternatively, they can also consist of a conventional unalloyed structural steel, such as for example the steel with the material number 1.0050.

Figure 3:
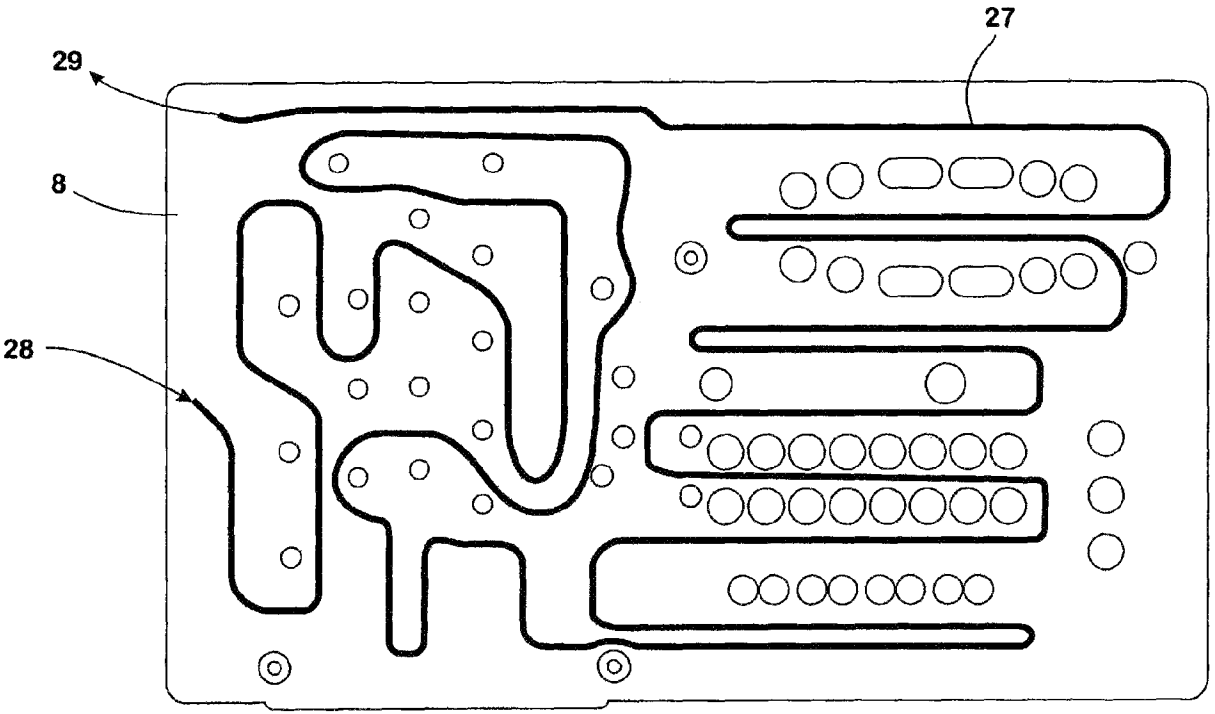
FIG. 3 a heating plate of the core box according to FIG. 1 in a top view.
Figure 4:
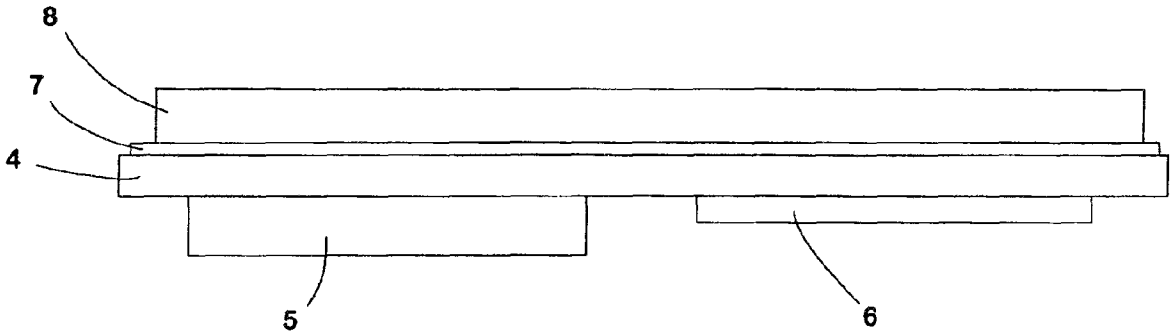
FIG. 4 a core box part of the core box according to FIG. 1 in a lateral view.

In the side 26, associated with the contour plate 4, of the heating plate 8 of the upper core box 2 depicted in FIG. 3, an oil line 27 is milled in the shape of a channel open to the side concerned. The oil line 27 is, in this regard, guided in a plurality of coils via the side 26 such that on the one hand all the temperature-critical regions of the contour plate 4 in the core shooting operation are covered, on the other hand however the regions through which the slotted nozzles 20, 21 are guided are also avoided. The inflow 28 and the outflow 29 are connected to an oil supply not depicted here, which conducts heated oil through the oil line 27 in the circuit at the required temperature.

An oil line 30 is moulded into the heating plate 23 in a corresponding manner.

The sealing plates 7, 22 also consist of a highly temperature-conductive material such as an Al material or a suitable steel such that the heat carried along by the flowing, hot oil through the oil line 27, 30 is transferred approximately free of losses to the respective contour plate 4, 16.

24 kg of quartz sand is mixed in a mixer with 2.2% of an inorganic binder and 0.9% of a powder additive added to improve the flow properties for manufacturing the already mentioned cores in the core box 1. To this end, the sand is firstly provided with the powder additive and then the liquid binder component is added while the mixer is running.

After a mixing time of approx. 30 s, the material mixture thus obtained is transferred into a storage tank of a conventionally constructed core shooter, but equipped with the core box 1.

The contour plates 4, 16 and the moulding elements 5, 6, 17, 18 are pre-heated by the heating plates 8, 23 to a temperature of 130° C. The material mixture is then shot into the mould cavity of the closed core box 1 by means of 5 bar applied pressure and remains there for 32 s.

In order to accelerate the curing, 2 s after the injecting, hot air is directed through the core box 1 with a pressure of 3.5 bar and a temperature of 160° C. for 30 s upon entering the tool.

After the curing time has concluded, the core box 1 is opened and the ejectors 25 are actuated. The fully cured cores can now be removed.

Practical tests carried out in the previously described manner have shown that in the case of the core box 1 according to the invention slotted nozzles can be introduced at any positions for optimising ventilation. Even in the case of using oil heating for heating the core box 1, the invention thus allows the contour plates thereof 4, 16 and the moulding elements 5, 6, 17, 18 borne thereby to be configured just as freely as is customary for core boxes which are used for so-called cold box methods, in which no heating is required, but rather in the case of which the curing takes place by a chemical reaction as a result of gassing with a reaction gas.

The freedom of shaping provided by the invention provides the possibility here of introducing additional slotted nozzles in the condensation areas, determined by the experiments and critical for the removal of the moisture, of the cores produced in the core box 1. By optimising the ventilation for the core boxes, the hot air rinse time could be reduced after the first optimisation loop and the cycle time thus reduced by 5 s.

LIST OF REFERENCE NUMERALS

1 Core box
2 Upper core box part
3 Lower core box part
4 Contour plate of the upper core box part 2
5,6 Contour-defining moulding elements of the upper core box part 2
7 Sealing plate of the upper core box part 2
8 Heating plate of the upper core box part 2
9 Shooting plate of the upper core box part 2
10,11 Mortise joints
12 Shooting funnel of the shooting plate 9
13 Shooting openings
14 Pins
15 Base frame of the lower core box part 3
16 Contour plate of the lower core box part 3
17,18 Contour-defining moulding elements of the lower core box part 3
19 Assembly openings
20 Slotted nozzles
21 Slotted nozzles
22 Sealing plate of the lower core box part 3
23 Heating plate of the lower core box part 3
24 Ejector plate
25 Ejectors
26 Side of the heating plate 8 associated with the contour plate 4
27 Oil line of the heating plate 8
28 Inflow of the oil line 27
29 Outflow of the oil line 27
30 Oil line of the heating plate 23

The invention claimed is:

1. A core box for manufacturing casting cores from a moulding material rigidified by a supply of heat, comprising at least two core box parts, which together provide the shape of the casting cores to be manufactured, wherein at least one of the core box parts is divided into a contour plate providing the shape of the casting core to be manufactured and a heating plate coupled to the contour plate which extends flat over the contour plate, wherein an open groove is moulded into the material of the heating plate on a side of the heating plate which extends parallel to the associated contour plate and the open groove together with the contour plate defines at least one oil line which is connected to an oil supply which feeds the oil line with a tempered oil for heating the at least one of the core box parts, and wherein the at least one oil line is guided in a plurality of coils such that temperature-critical regions of the contour plate are covered by the at least one oil line and the at least one oil line avoids venting nozzles extending through the contour plate.

2. The core box according to claim 1, wherein the heating plate consists of a thermally conductive material.

3. The core box according to claim 2, wherein a sealing plate is located on the side of the heating plate into which the groove is moulded.

4. The core box according to claim 3, wherein the sealing plate consists of a thermally conductive material.

5. The core box according to claim 4, wherein at least one of the contour plate and the heating plate consist of a material having a conductivity λ of at least 40 W/(m*K).

6. The core box according to claim 2, wherein at least one of the contour plate and the heating plate consist of a material having a conductivity λ of at least 40 W/(m*K).

7. The core box according to claim 3, wherein at least one of the contour plate and the heating plate consist of a material having a conductivity λ of at least 40 W/(m*K).

8. The core box according to claim 1, wherein the groove is moulded into a side of the heating plate which is associated with the contour plate.

9. The core box according to claim 8, wherein a sealing plate is located on the side of the heating plate into which the groove is moulded.

10. The core box according to claim 9, wherein the sealing plate consists of a thermally conductive material.

11. The core box according to claim 10, wherein at least one of the contour plate and the heating plate consist of a material having a conductivity λ of at least 40 W/(m*K).

12. The core box according to claim 8, wherein at least one of the contour plate and the heating plate consist of a material having a conductivity λ of at least 40 W/(m*K).

13. The core box according to claim 9, wherein at least one of the contour plate and the heating plate consist of a material having a conductivity λ of at least 40 W/(m*K).

14. The core box according to claim 1, wherein a sealing plate is located on the side of the heating plate into which the groove is moulded.

15. The core box according to claim 14, wherein the sealing plate consists of a thermally conductive material.

16. The core box according to claim 15, wherein at least one of the contour plate, the heating plate and the sealing plate consist of a material having a conductivity λ of at least 40 W/(m*K).

17. The core box according to claim 1, wherein at least one of the contour plate and the heating plate consist of a material having a conductivity λ of at least 40 W/(m*K).

18. The core box according to claim 14, wherein at least one of the contour plate, the heating plate and the sealing plate consist of a material having a conductivity λ of at least 40 W/(m*K).

* * * * *